US006951123B2

(12) United States Patent
Chong

(10) Patent No.: US 6,951,123 B2
(45) Date of Patent: Oct. 4, 2005

(54) REKEYABLE LOCK

(75) Inventor: Gerald B. Chong, Rowland Heights, CA (US)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 10/379,930

(22) Filed: Mar. 5, 2003

(65) Prior Publication Data

US 2004/0172994 A1 Sep. 9, 2004

(51) Int. Cl.[7] ..... E05B 27/00

(52) U.S. Cl. ..... 70/493; 70/367; 70/370; 70/371

(58) Field of Search ..... 70/493, 378, 358, 70/367, 370, 371

(56) References Cited

U.S. PATENT DOCUMENTS

| | | | | |
|---|---|---|---|---|
| 1,565,556 | A | | 12/1925 | Fremon |
| 1,610,224 | A | | 12/1926 | Dalboni et al. |
| 1,965,889 | A | | 7/1934 | Gerald |
| 2,139,842 | A | | 12/1938 | Miller |
| 2,194,469 | A | | 3/1940 | Fremon |
| 2,232,017 | A | | 2/1941 | Wilder |
| 2,370,862 | A | | 3/1945 | Johnstone |
| 2,391,832 | A | | 12/1945 | Johnstone |
| 2,895,323 | A | | 7/1959 | Ernest |
| 2,977,786 | A | * | 4/1961 | Marron et al. ..... 70/493 |
| 3,149,486 | A | | 9/1964 | Russell |
| 3,183,692 | A | | 5/1965 | Check |
| 3,190,093 | A | | 6/1965 | Schlage |
| 3,320,781 | A | | 5/1967 | Hill |
| 3,589,153 | A | | 6/1971 | Hill |
| 3,667,262 | A | | 6/1972 | Hill |
| 3,726,116 | A | | 4/1973 | Dimotta |
| 3,728,880 | A | | 4/1973 | Falk |
| 3,735,612 | A | | 5/1973 | Popovici |
| 3,754,422 | A | | 8/1973 | Stackhouse |
| 3,910,083 | A | | 10/1975 | Burlingame |
| 3,990,282 | A | | 11/1976 | Sorum |
| 3,999,413 | A | | 12/1976 | Raymond et al. |
| 4,015,458 | A | | 4/1977 | Mercurio |
| 4,069,694 | A | | 1/1978 | Raymond et al. |
| 4,094,175 | A | | 6/1978 | Pechner |
| 4,142,391 | A | | 3/1979 | Paig |
| 4,320,639 | A | | 3/1982 | Kleefeldt et al. |
| 4,372,139 | A | | 2/1983 | Laake |

(Continued)

FOREIGN PATENT DOCUMENTS

| | | |
|---|---|---|
| EP | 0 157 967 | 10/1985 |
| EP | 0 210 037 | 1/1987 |
| EP | 0 872 615 | 10/1998 |
| WO | WO 93/14290 | 7/1993 |
| WO | WO 97/36072 | 10/1997 |

*Primary Examiner*—John B. Walsh
(74) *Attorney, Agent, or Firm*—Richard J. Veltman; John D. DelPonti

(57) ABSTRACT

A rekeyable lock cylinder comprising: a cylinder body having a longitudinal axis and defining a longitudinally spaced, radially-aligned first plurality of pin chambers, each of said first plurality of pin chambers adapted to house a corresponding first pin, said cylinder body further defining a longitudinally extending slot therethrough; and a plug assembly disposed in said cylinder body, said plug assembly comprising a plug body defining a second plurality of pin chambers, each of said second plurality of pin chambers adapted to house a corresponding second pin, said plug body rotatable within said cylinder body between a first position and a second position, said first position aligning said second plurality of pin chambers with said first plurality of pin chambers, said second plurality of pins removable from said second plurality of pin chambers when said plug body is in said second position.

2 Claims, 13 Drawing Sheets

U.S. PATENT DOCUMENTS 4,376,382 A 3/1983 Raymond et al.
4,377,940 A 3/1983 Hucknall
4,393,673 A 7/1983 Widen
4,404,824 A 9/1983 Hennessy
4,412,437 A 11/1983 Smith
4,440,009 A 4/1984 Smith
4,689,978 A 9/1987 Drummond
4,712,399 A 12/1987 Mattossovich
4,712,401 A 12/1987 Monahan
4,712,402 A 12/1987 Monahan
4,729,231 A 3/1988 Wu
4,732,023 A 3/1988 Shen
4,741,188 A 5/1988 Smith
4,747,281 A 5/1988 Monahan
4,765,163 A 8/1988 Trull et al.
4,794,772 A 1/1989 Falk et al.
4,836,002 A 6/1989 Monahan
4,850,210 A 7/1989 Adler et al.
4,899,563 A 2/1990 Martin
4,909,053 A 3/1990 Zipf, III et al.
4,912,953 A 4/1990 Wobig
4,920,774 A 5/1990 Martin
4,942,749 A 7/1990 Rabinow
4,966,021 A 10/1990 Boag
4,996,856 A 3/1991 Lin et al.
5,010,753 A 4/1991 Boris, Jr.
5,024,071 A 6/1991 Shafirkin
5,038,589 A 8/1991 Martin
5,044,180 A 9/1991 Lebrecht
5,076,081 A 12/1991 Boris, Jr.
5,121,619 A 6/1992 Martin
5,174,136 A 12/1992 Thwing
5,209,088 A 5/1993 Vaks
5,211,044 A 5/1993 Kim
5,233,850 A 8/1993 Schroeder
5,325,690 A 7/1994 Adler et al.
5,428,978 A 7/1995 Tsukano
5,431,034 A * 7/1995 Fann et al. ..... 70/369
5,540,071 A 7/1996 Reikher
5,640,865 A 6/1997 Widen
5,704,234 A 1/1998 Resch
5,718,136 A 2/1998 Aldieri et al.
5,752,400 A 5/1998 Kim
5,765,417 A 6/1998 Bolton
5,791,181 A 8/1998 Sperber et al.
5,884,512 A 3/1999 Wayne
5,921,122 A 7/1999 Lin
5,921,123 A 7/1999 Schwarzkopf et al.
5,970,760 A 10/1999 Shen
5,979,200 A 11/1999 Cliff
6,029,484 A 2/2000 Jetton
6,047,577 A 4/2000 Klimas
6,076,386 A 6/2000 Etchells et al.
6,079,240 A 6/2000 Shvarts
6,119,495 A 9/2000 Loreti
6,134,928 A 10/2000 Kang
6,142,717 A 11/2000 Staiger
6,295,850 B1 10/2001 Anderson
6,425,274 B1 7/2002 Laitala et al.
6,516,643 B1 2/2003 Olshausen
6,523,378 B2 2/2003 Kuo
6,532,782 B2 * 3/2003 Chiu ..... 70/369
6,564,601 B2 5/2003 Hyatt Jr.
6,776,017 B2 8/2004 Herdman
2003/0037582 A1 2/2003 Edwards, Jr. et al.
2003/0084692 A1 5/2003 Herdman
2003/0089149 A1 5/2003 Suzuki et al.
2003/0154753 A1 8/2003 Dimig et al.
2004/0069030 A1 4/2004 Takadama

* cited by examiner

REKEYABLE LOCK

BRIEF DESCRIPTION OF THE DRAWINGS

The invention and its wide variety of potential embodiments will be readily understood via the following detailed description of certain exemplary embodiments, with reference to the accompanying drawings in which.

DETAILED DESCRIPTION

Figure 1:
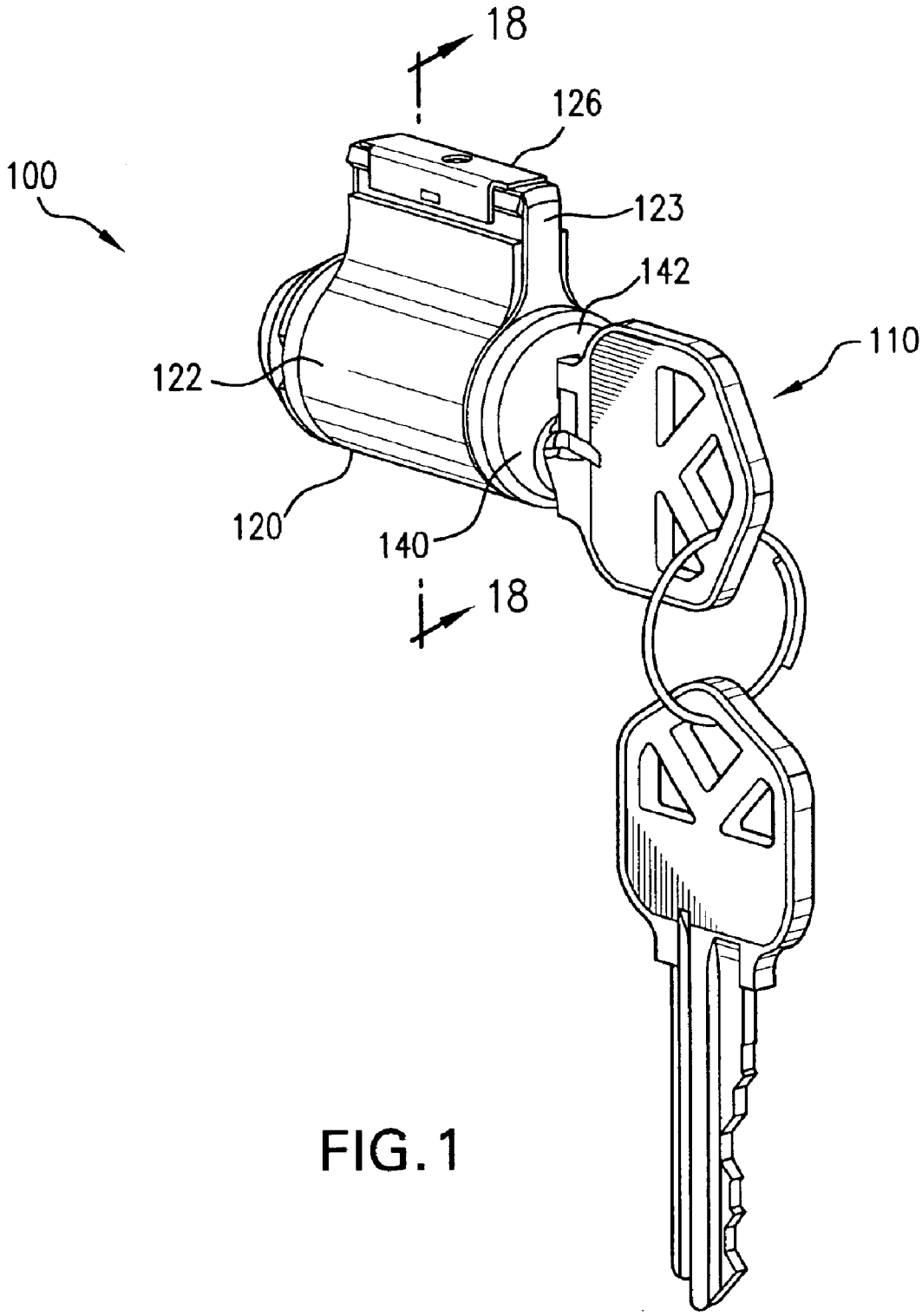
FIG. 1 is a front perspective view of an exemplary embodiment of a system 100 of the present invention.

Certain exemplary embodiments of the present invention provide a rekeyable lock cylinder, comprising: a cylinder body having a longitudinal axis and defining a longitudinally spaced, radially-aligned first plurality of pin chambers, each of said first plurality of pin chambers adapted to house a corresponding first pin, said cylinder body further defining a longitudinally extending slot therethrough; and a plug assembly disposed in said cylinder body, said plug assembly comprising a plug body defining a second plurality of pin chambers, each of said second plurality of pin chambers adapted to house a corresponding second pin, said plug body rotatable within said cylinder body between a first position and a second position, said first position aligning said second plurality of pin chambers with said first plurality of pin chambers, said second position aligning said second plurality of pin chambers with said slot, said second plurality of pins removable from said second plurality of pin chambers when said plug body is in said second position.

Certain exemplary embodiments of the present invention provide a method for rekeying a lock cylinder, comprising the activities of: inserting a key into a plug assembly disposed in a cylinder body, said cylinder body having a longitudinal axis and defining a longitudinally spaced, radially-aligned first plurality of pin chambers, each of said first plurality of pin chambers adapted to house a first pin, said cylinder body further defining a longitudinally extending slot therethrough, said plug assembly disposed in said cylinder body, said plug assembly comprising a plug body defining a second plurality of pin chambers, each of said second plurality of pin chambers adapted to house a second pin; rotating said plug assembly within said cylinder body from a first position to a second position, said first position aligning said second plurality of pin chambers with said first plurality of pin chambers, said second position aligning said second plurality of pin chambers with said slot, and removing said second plurality of pins from said second plurality of pin chambers when said plug body is in said second position.

Certain exemplary embodiments of the present invention provide a system comprising: a rekeyable lock cylinder coupled to a door, said rekeyable lock cylinder comprising: a cylinder body having a longitudinal axis and defining a longitudinally spaced, radially-aligned first plurality of pin chambers, each of said first plurality of pin chambers adapted to house a corresponding first pin, said cylinder body further defining a longitudinally extending slot therethrough; and a plug assembly disposed in said cylinder body, said plug assembly comprising a plug body defining a second plurality of pin chambers, each of said second plurality of pin chambers adapted to house a corresponding second pin; wherein said plug body is rotatable within said cylinder body between a first position and a second position, said first position aligning said second plurality of pin chambers with said first plurality of pin chambers, said second position aligning said second plurality of pin chambers with said slot, said second plurality of pins non-destructively removable from said second plurality of pin chambers when said rekeyable lock cylinder is removed from said door and said plug body is in said second position.

Figure 18:
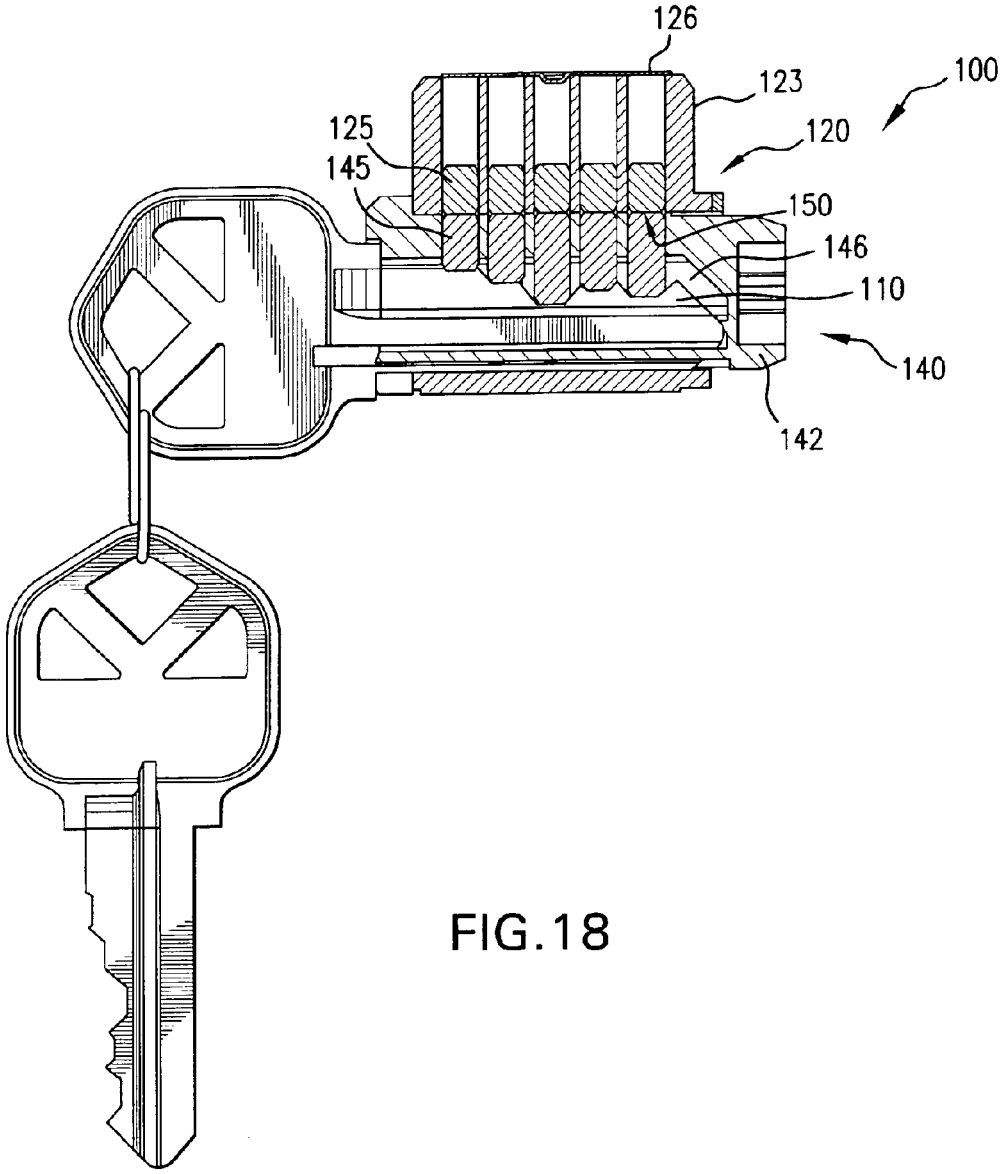
FIG. 18 is a section view, taken along section lines 18—18 of FIG. 1, of an exemplary embodiment of a system 100 of the present invention.
Figure 19:
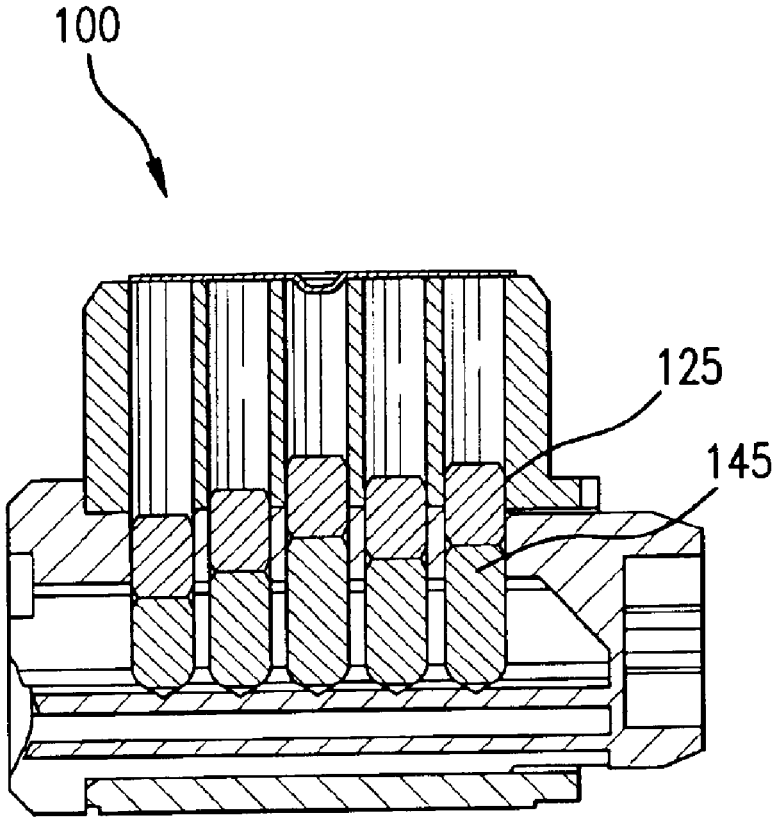
FIG. 19 is a section view, taken along section lines 18—18 of FIG. 1, of an exemplary embodiment of a system 100 of the present invention, shown with the key removed.

FIG. 1 is a front perspective view of an exemplary embodiment of a system 100 of the present invention, and FIGS. 18 and 19 are section views, taken along section lines 18—18 of FIG. 1, with FIG. 18 showing a key inserted, and FIG. 19 showing the key removed. Referring to FIGS. 1, 18, and 19, system 100 can include a key 110, a lock cylinder assembly 120 comprising a cylinder body 122, a chimney 123, and a chimney cap 126, and a plug assembly 140 comprising a plug body 142. Upon insertion of key 110 into keyway 146 of plug assembly 140, plug pins 145 relocate to conform to the cut of the key 110, thereby relocating spring-loaded cylinder pins 125 located in chimney 123 such that a shear line 150 is established, allowing plug assembly 140 to rotate within cylinder assembly 120. Upon removal of key 110 from keyway 146, spring-loaded cylinder pins 125 can relocate plug pins 145 to a bottom of their travel, thereby eliminating and/or blocking shear line 150 and preventing rotation of plug assembly 140 within cylinder assembly 120. System 100 can be installed in a door to lock the door to prevent opening unless key 110 is used to rotate plug assembly 140 from a lock position to an unlock position.

Figure 2:
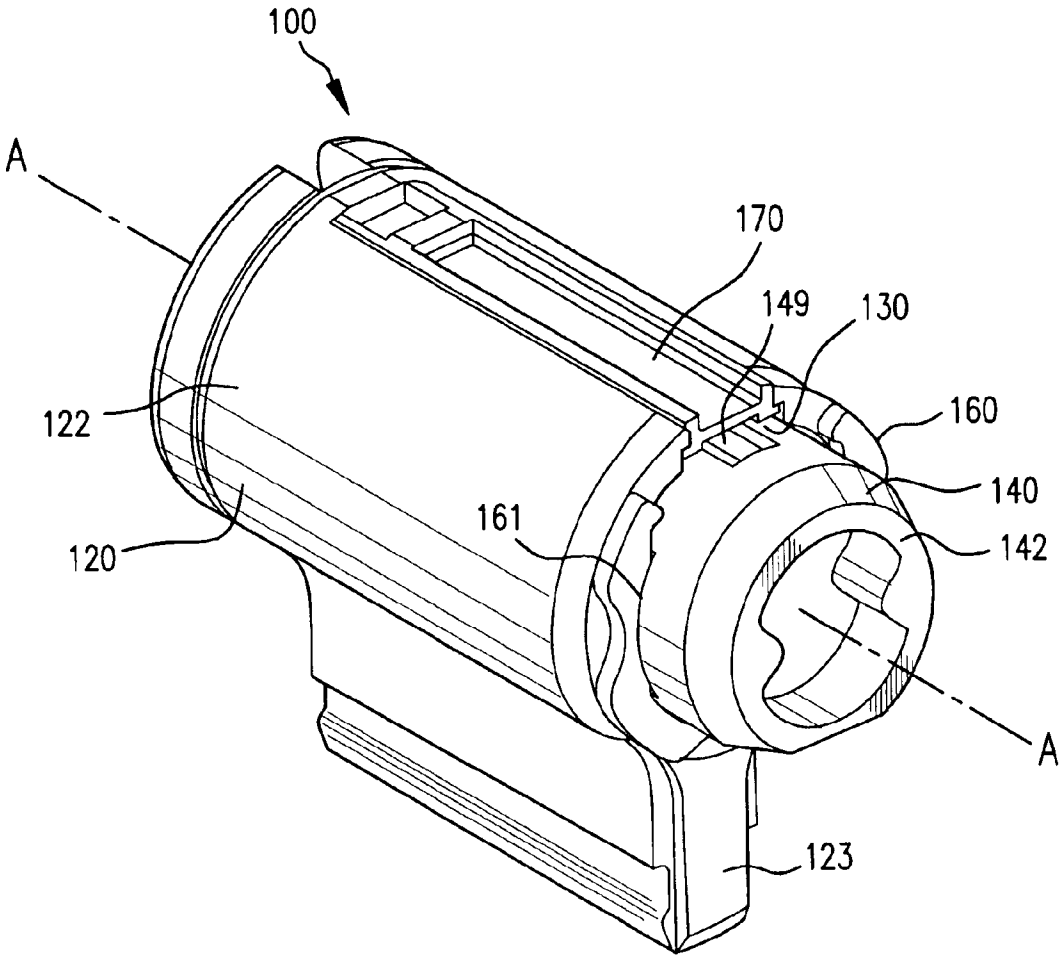
FIG. 2 is a rear perspective view of an exemplary embodiment of a system 100 of the present invention in a pre-rekeying position.

FIG. 2 is a rear perspective view of an exemplary embodiment of a system 100 of the present invention in a pre-rekeying position. Note that cylinder assembly 120 is shown rotated 180 degrees about its longitudinal axis A—A with respect to the orientation of cylinder assembly 120 in FIG. 1. Thus, cylinder body 122 and chimney 123 are also rotated 180 degrees. Visible in this view are a longitudinal slot 130 cut through an annular wall of cylinder body 122 along a substantial portion of a length of cylinder body 122. Inserted in slot 130 is a slot cover 170, which is retained in slot 130 by slot cover retainer 149, which can be integral to plug body 142. Also shown is a plug clip 160 disposed in clip-retainig slot 161 that serves to limit relative motion of plug body 142 with respect to cylinder body 122 along longitudinal axis A—A.

Figure 3:
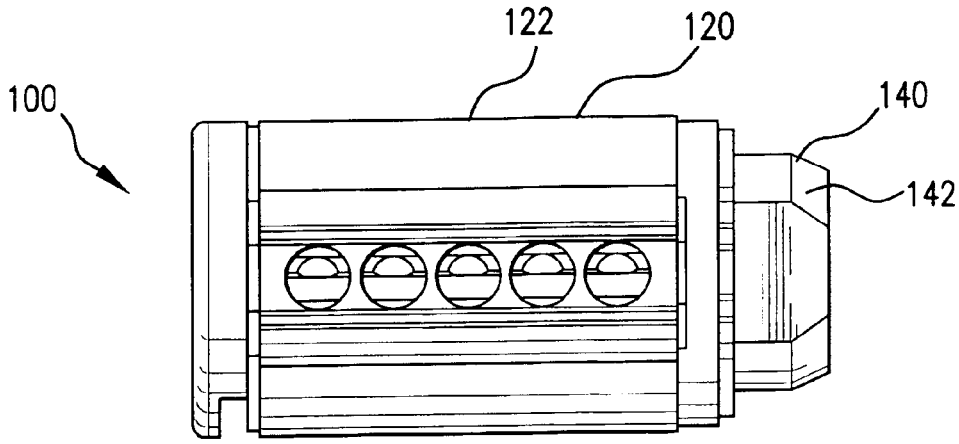
FIG. 3 is a top view of an exemplary embodiment of a system 100 of the present invention.

FIG. 3 is a top view of an exemplary embodiment of a system 100 of the present invention. Shown are cylinder assembly 120, cylinder body 122, plug assembly 140, and plug body 142.

Figure 4:
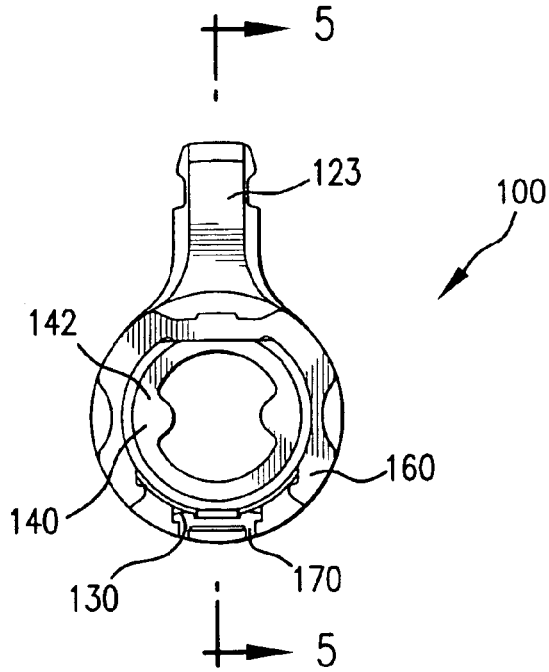
FIG. 4 is a rear view of an exemplary embodiment of a system 100 of the present invention.

FIG. 4 is a rear view of an exemplary embodiment of a system 100 of the present invention. Shown are chimney 123, cylinder slot 130, plug assembly 140, plug body 142, plug clip 160, and slot cover 170.

Figure 5:
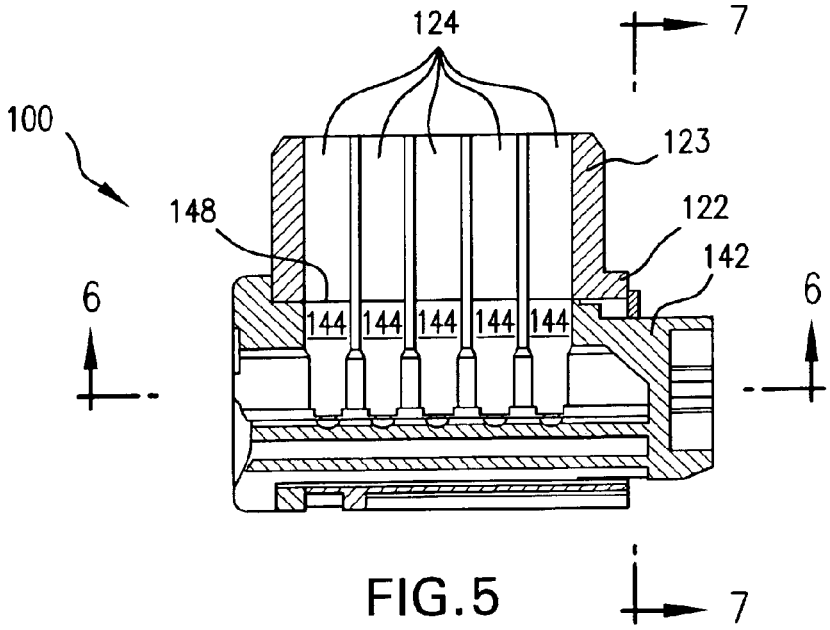
FIG. 5 is a section view, taken along section lines 5—5 of FIG. 4, of an exemplary embodiment of a system 100 of the present invention.

FIG. 5 is a section view, taken along section lines 5—5 of FIG. 4, of an exemplary embodiment of a system 100 of the present invention. Shown are cylinder body 122, chimney 123, a plurality of cylinder pin chambers 124 each adapted to substantially contain a spring-loaded cylinder pin (not shown), plug body 142, and a plurality of plug pin chambers 144 each adapted to substantially contain a plug pin (not shown). Upon proper insertion of a proper key into plug body 142, plug pins (not shown) relocate to conform to the cut of the key, thereby relocating spring-loaded cylinder pins (not shown) located in chimney 123 such that a shear line 148 is established, allowing plug body 142 to rotate within cylinder body 122.

Figure 6:
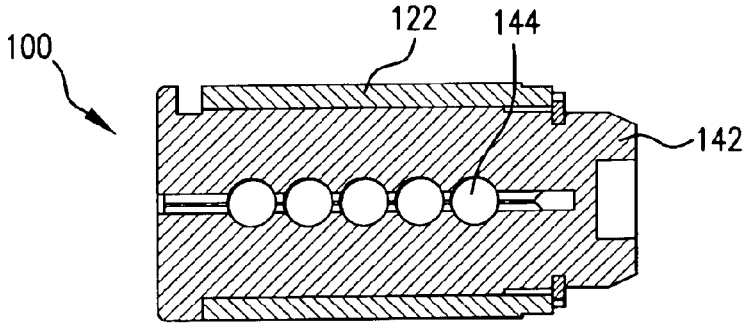
FIG. 6 is a section view, taken along section lines 6—6 of FIG. 5, of an exemplary embodiment of a system 100 of the present invention.

FIG. 6 is a section view, taken along section lines 6—6 of FIG. 5, of an exemplary embodiment of a system 100 of the present invention. Shown are cylinder body 122, plug body 142, plug pin chambers 144.

Figure 7:
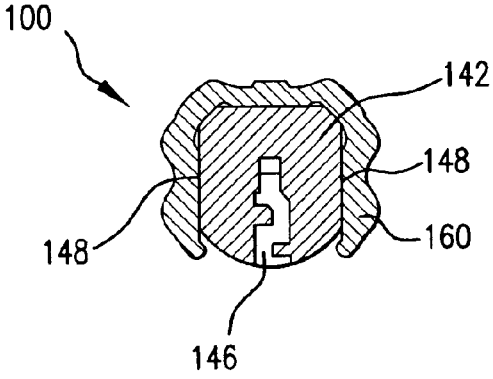
FIG. 7 is a section view, taken along section lines 7—7 of FIG. 5, of an exemplary embodiment of a system 100 of the present invention.

FIG. 7 is a section view, taken through the clip-receiving slot 161 along section lines 7—7 of FIG. 5, of an exemplary embodiment of a system 100 of the present invention. Shown are plug body 142, keyway 146, clip engagement surfaces 148, and a plug clip 160 engaging with clip engagement surfaces 148 of plug body 142.

Figure 8:
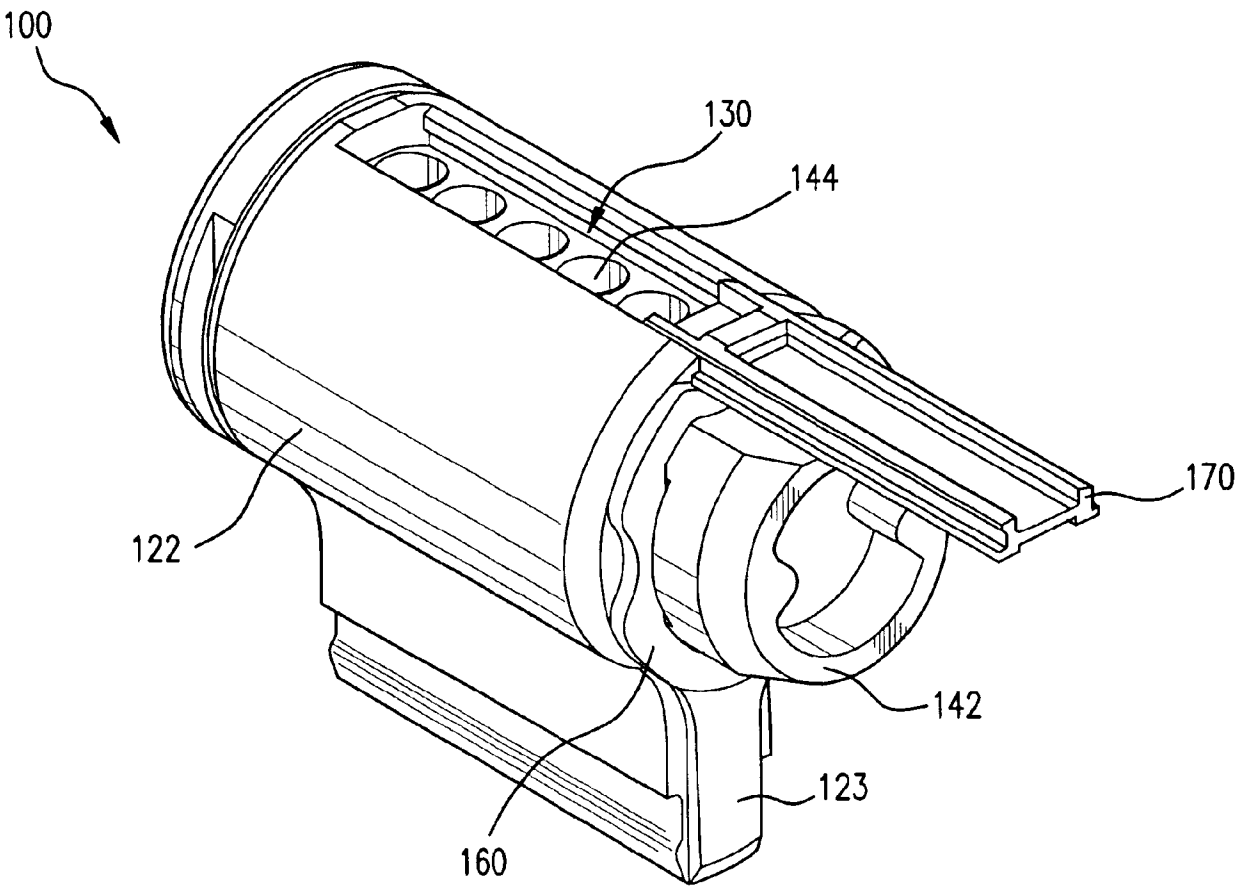
FIG. 8 is a rear perspective view of an exemplary embodiment of a system 100 of the present invention in a rekeying position.

FIG. 8 is a rear perspective view of an exemplary embodiment of a system 100 of the present invention in a rekeying position. FIG. 8 is similar to FIG. 2, except that plug 142 is in a rekeying position, and slot cover 170 has been partially removed to uncover slot 130 and plug pin chambers 144. Note the change in orientation of plug clip 160 with respect to its orientation in FIG. 2, and that because slot cover retainer 149 (shown in FIG. 2) has rotated with plug body 142, slot cover 170 can be at least partially longitudinally removed from slot 130.

Figure 9:
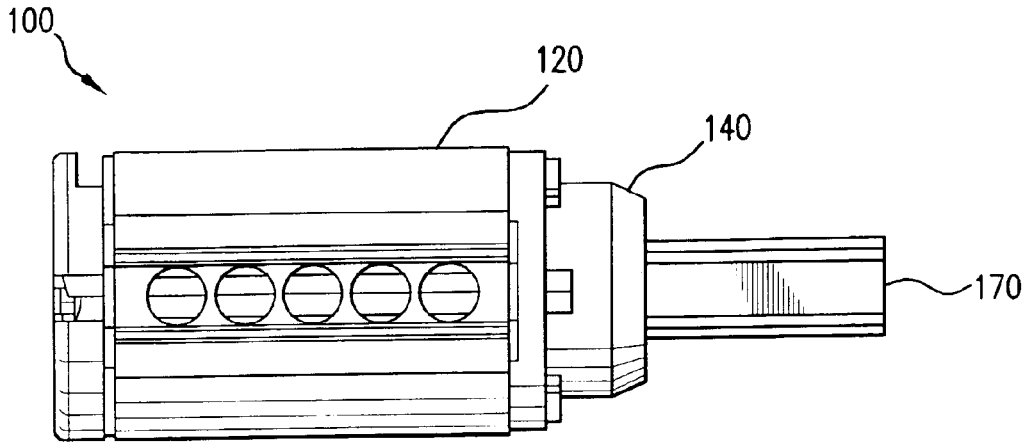
FIG. 9 is a top view of an exemplary embodiment of a system 100 of the present invention.

FIG. 9 is a top view of an exemplary embodiment of a system 100 of the present invention. Shown are cylinder assembly 120, plug assembly 140, and partially removed slot cover 170.

Figure 10:
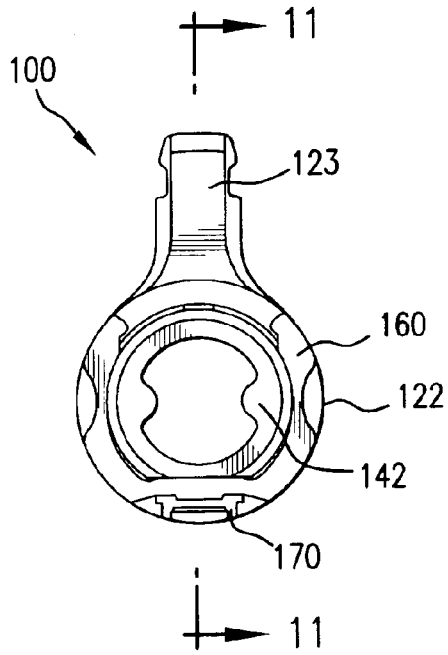
FIG. 10 is a rear view of an exemplary embodiment of a system 100 of the present invention.

FIG. 10 is a rear view of an exemplary embodiment of a system 100 of the present invention. Shown are cylinder body 122, chimney 123, plug body 142, plug clip 160, and slot cover 170.

Figure 11:
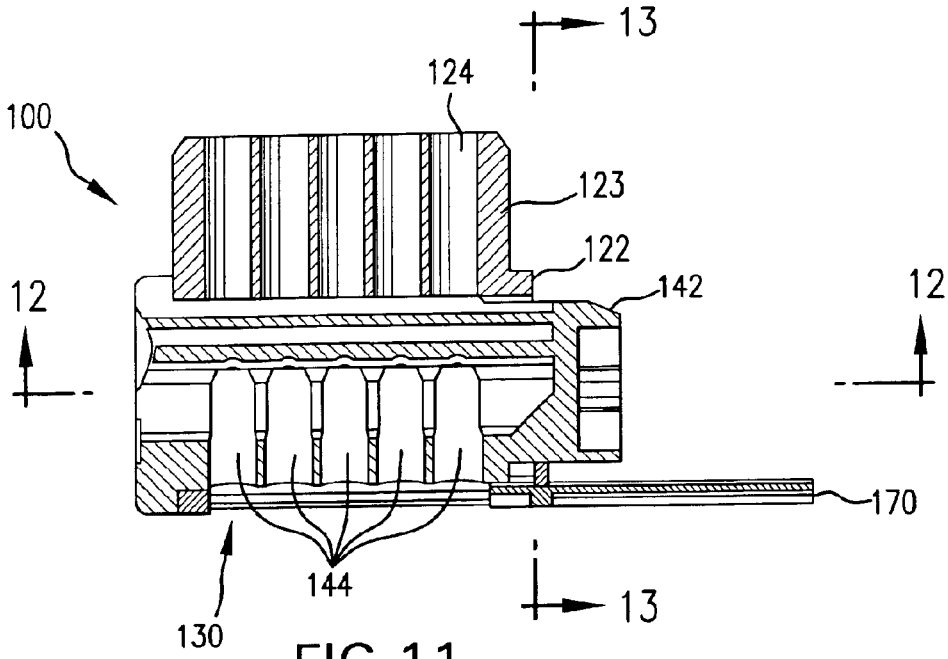
FIG. 11 is a section view, taken along section lines 11—11 of FIG. 10, of an exemplary embodiment of a system 100 of the present invention.

FIG. 11 is a section view, taken along section lines 11—11 of FIG. 10, of an exemplary embodiment of a system 100 of the present invention. Shown are cylinder body 122, chimney 123, a plurality of cylinder pin chambers 124 each adapted to substantially contain a spring-loaded cylinder pin (not shown), plug body 142. Note that the plurality of plug pin chambers 144 are rotated 180 degrees with respect to their orientation in FIG. 5. Note also that, because of the orientation of plug body 142, and the at least partial removal of slot cover 170 from slot 130, plug pins (not shown) are free to be removed or fall from plug pins chambers 144.

Figure 12:
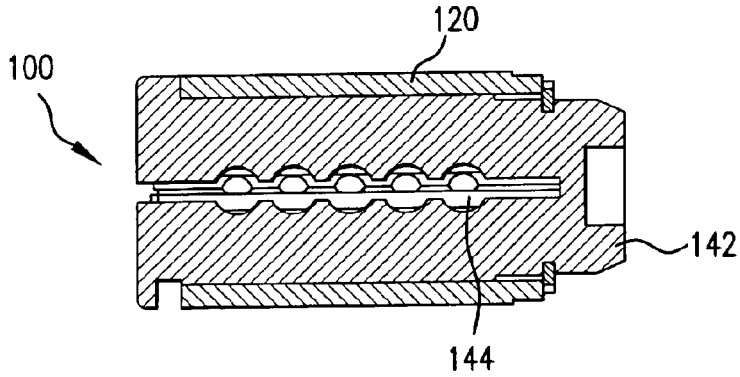
FIG. 12 is a section view, taken along section lines 12—12 of FIG. 11, of an exemplary embodiment of a system 100 of the present invention.

FIG. 12 is a section view, taken along section lines 12—12 of FIG. 11, of an exemplary embodiment of a system 100 of the present invention. Shown are cylinder body 122, plug body 142, plug pin chambers 144.

Figure 13:
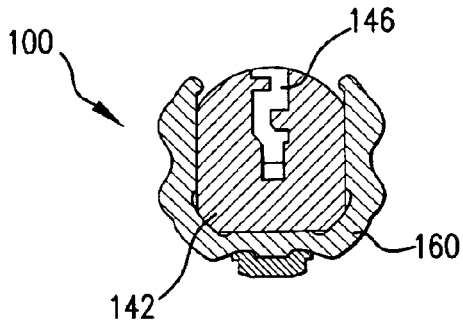
FIG. 13 is a section view, taken along section lines 13—13 of FIG. 11, of an exemplary embodiment of a system 100 of the present invention.

FIG. 13 is a section view, taken along section lines 13—13 of FIG. 11, of an exemplary embodiment of a system 100 of the present invention. Shown are plug body 142, plug keyway 146, and plug clip 160. Note that plug keyway 146 is rotated 180 degrees with respect to its orientation in FIG. 7.

Figure 14:
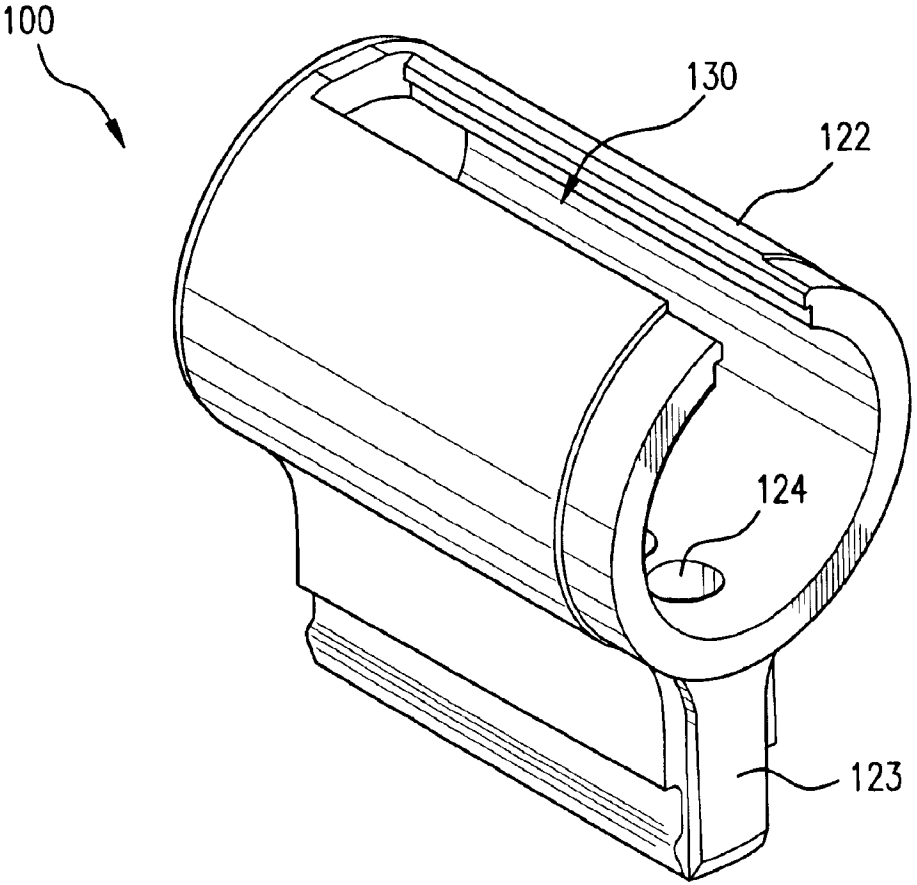
FIG. 14 is a rear perspective view of an exemplary embodiment of a cylinder of the present invention.

FIG. 14 is a rear perspective view of an exemplary embodiment of a cylinder of the present invention. Shown are cylinder body 122, chimney 123, at least one of cylinder pin chambers 124, and slot 130.

Figure 15:
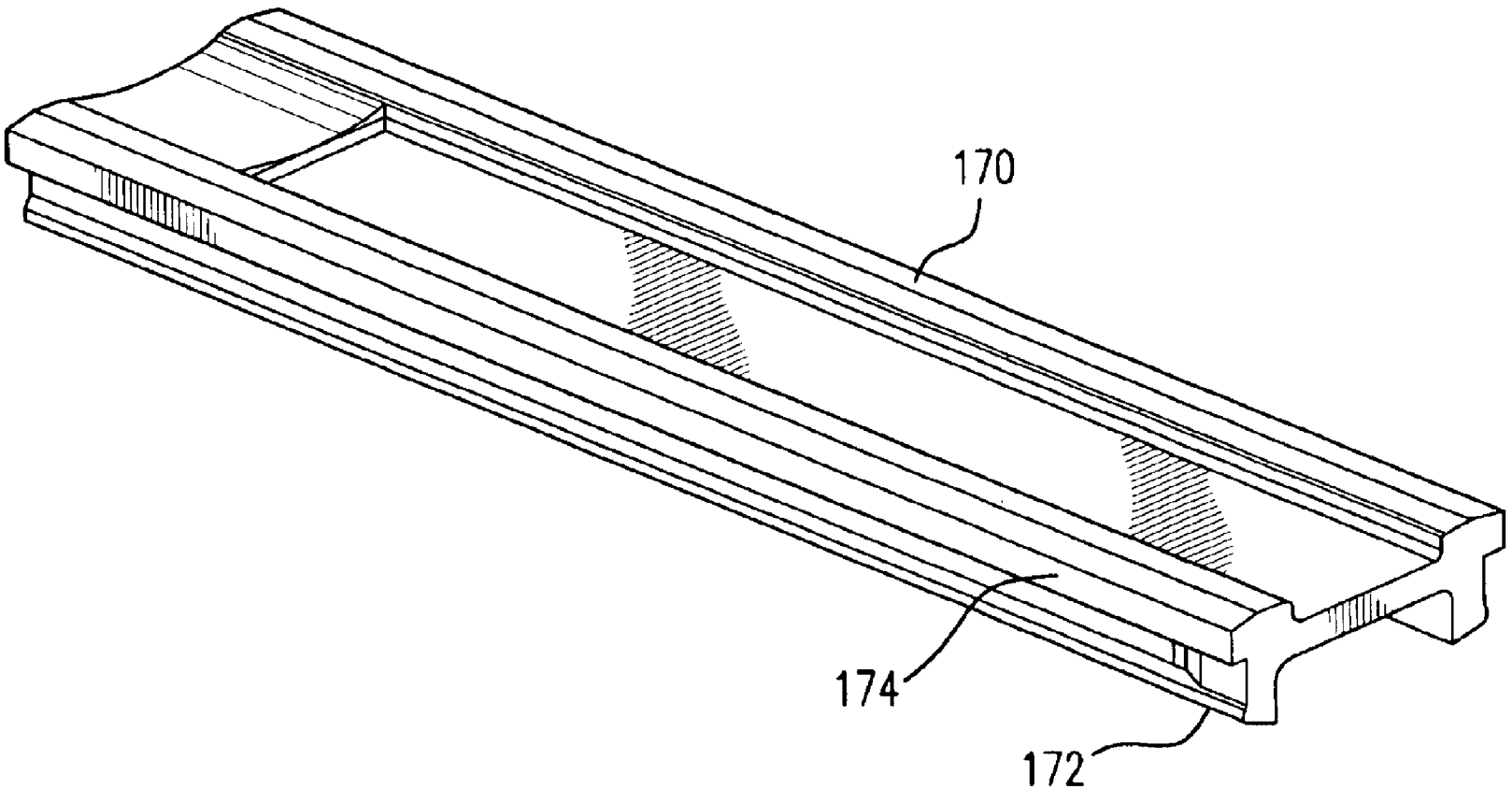
FIG. 15 is a perspective view of an exemplary embodiment of a slot cover of the present invention.

FIG. 15 is a perspective view of an exemplary embodiment of a slot cover 170 of the present invention. Shown is slot cover inner lip 172, which can resist radially outward movement of slot cover 170 with respect to cylinder body 122 (not shown). Also shown is slot cover outer lip 174, which can resist radially inward movement of slot cover 170 with respect to cylinder body 122 (not shown).

Figure 16:
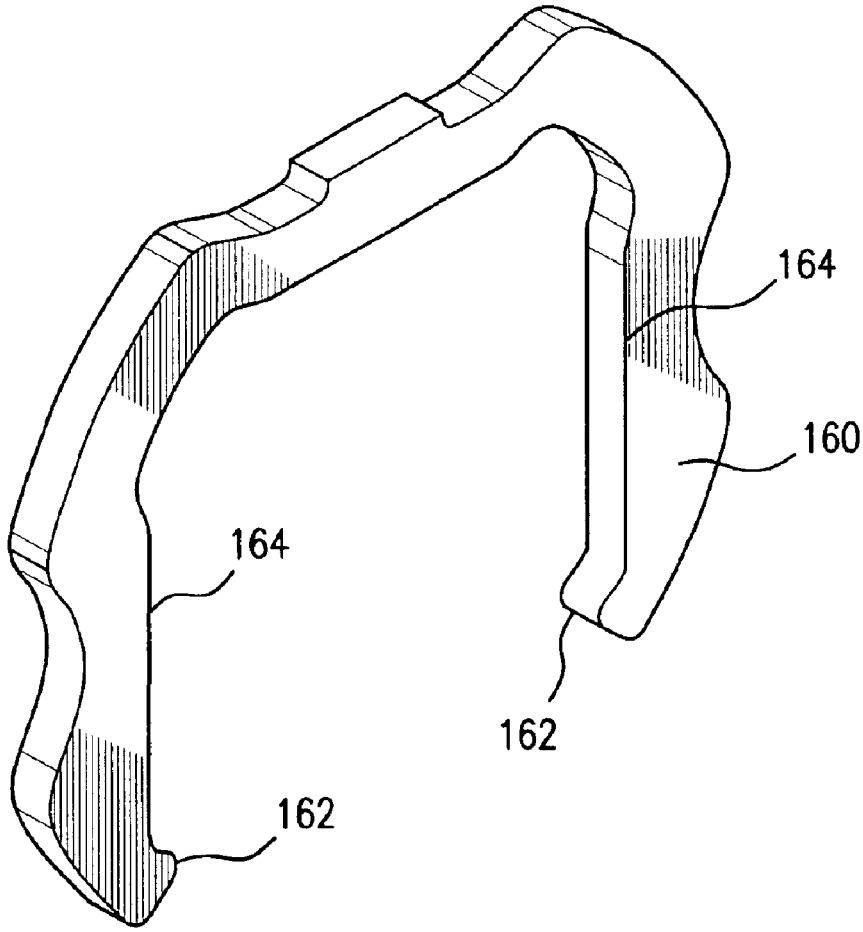
FIG. 16 is a perspective view of an exemplary embodiment of a plug clip of the present invention.

FIG. 16 is a perspective view of an exemplary embodiment of a plug clip 160 of the present invention. Shown are plug clip protrusions 162, which can interact with plug body 142 (not shown) to resist radial movement of plug clip 160 with respect to plug body 142. Also shown are plug clip inner walls 164, which can interact with plug body 142 (not shown) to resist longitudinal movement of plug clip 160 and/or cylinder body 122 (not shown) with respect to plug body 142.

Figure 17:
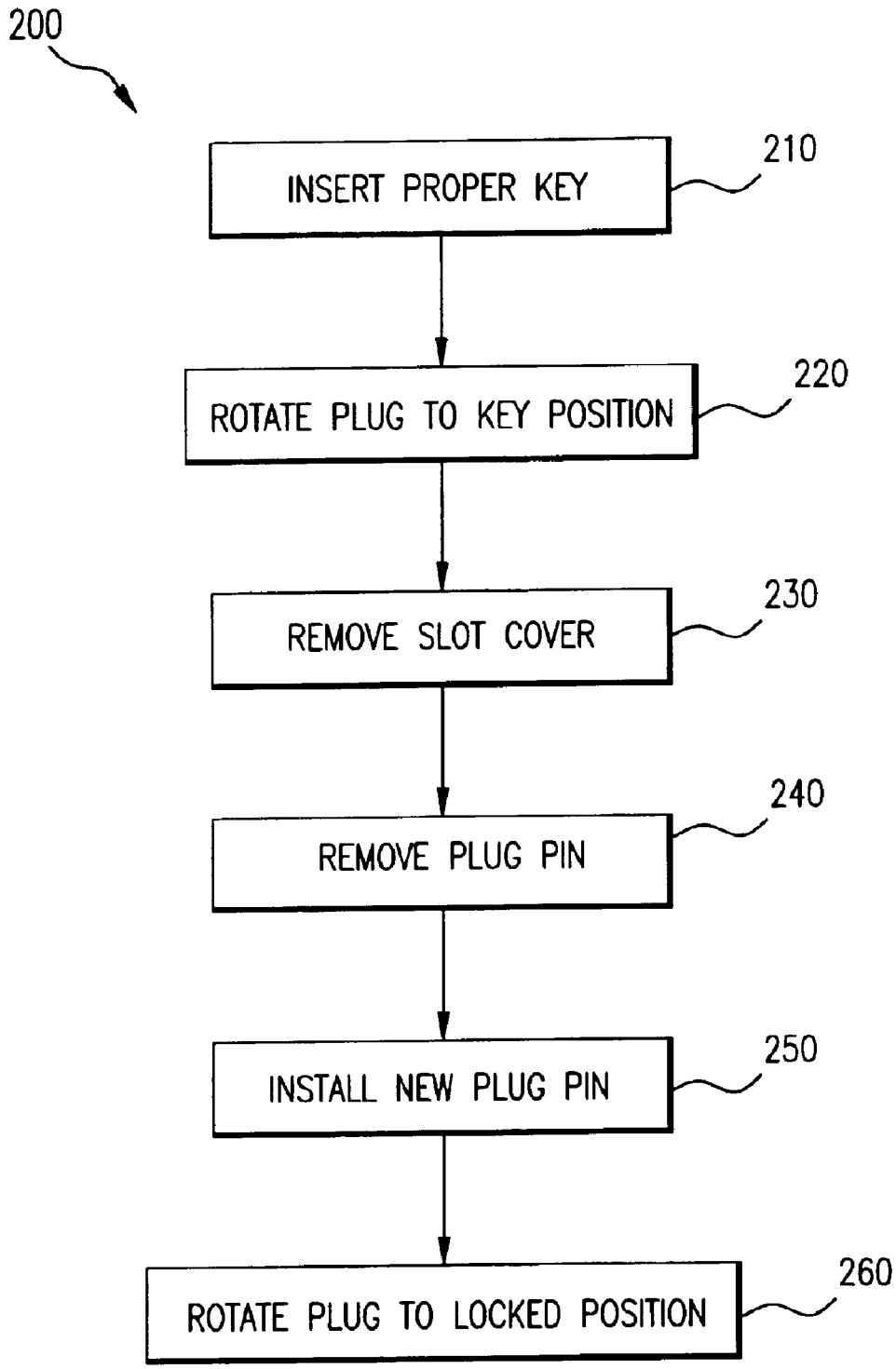
FIG. 17 is a flowchart of an exemplary embodiment of a method 200 of the present invention.

FIG. 17 is a flowchart of an exemplary embodiment of a method 200 of the present invention. At activity 210, a proper key is inserted into the plug assembly, thereby relocating plug pins and cylinder pins to establish and/or align with a shear line, and thereby allow rotation of the plug assembly within the cylinder assembly.

At activity 220, torsion is applied to the key to rotate the plug assembly with the cylinder body from a locked position to an unlocked position and/or to a rekeying position. The unlocked position can occur at any orientation with respect to the locked position, such as from approximately 10 degrees to approximately 250 degrees, including each number therebetween, such as approximately 30.05, 62, 90, 118.7, 150.03, 180, and/or 224 degrees, etc. The rekeying position can occur at any orientation with respect to the first locked position, such as from approximately 10 degrees to approximately 250 degrees, including each number therebetween, such as approximately 30.05, 62, 90, 118.7, 150.03, 180, and/or 224 degrees, etc.

At activity 230, with the plug assembly rotated to the rekeying position, the slot cover can be slid longitudinally within the slot and at least partially removed. At activity 240, at least one of the plug pins can be removed from the plug body. If the rekeying position orients the plug pins chambers vertically, the plug pins can fall from the plug pin chambers. Note that at least one of the plug pins can be removed from the plug pin chambers without removing the plug clip or removing the plug body from the cylinder body. Note also that because there is no need to remove the plug assembly from the cylinder assembly, no plug follower is required for rekeying. At this point, the old key can be removed, and a new key can be inserted.

At activity 250, at least one of the plug pins can be replaced with a plug pin of a different length, thereby requiring a different key to rotate the plug body within the cylinder body. Afterwards, the slot cover can be repositioned.

At activity 260, with the new key in place, in the plug assembly can be rotated to the locked or unlocked position.

Thus, embodiments of the present invention can provide a method for rapidly rekeying a lock cylinder without the need for a plug follower or for removing the plug assembly from the cylinder assembly. Morever, in certain embodiments of the present invention, the rekeyer is not required to remove a cylinder chimney cover, cylinder pin springs, or cylinder pins.

Although the invention has been described with reference to specific exemplary embodiments thereof, it will be understood that numerous variations, modifications and additional embodiments are possible, and accordingly, all such variations, modifications, and embodiments are to be regarded as being within the spirit and scope of the invention. Also, references specifically identified and discussed herein are incorporated by reference as if fully set forth herein. Accordingly, the drawings and descriptions are to be regarded as illustrative in nature, and not as restrictive.

What is claimed is:

1. A rekeyable lock cylinder comprising a cylinder body having a longitudinal axis and defining a longitudinally spaced, radially-aligned first plurality of pin chambers, each of said first plurality of pin chambers adapted to house a corresponding first pin, and said cylinder body further defining a longitudinally extending slot therethrough;

a plug assembly disposed in said cylinder body, said plug assembly comprising a plug body defining a clip-receiving slot extending transverse to said longitudinal axis an a second plurality of pin chambers, each of said second plurality of pin chambers adapted to house a corresponding second pin, said plug body rotatable within said cylinder body between a first position and a second position, said first position aligning said second plurality of pin chambers with said first plurality of pin chambers with said slot, said second plurality of pins removable from said second plurality of pin chambers when said plug body is in said second position; and a plug clip adapted to prevent longitudinal separation of said plug body from said cylinder body, and adapted to prevent removal of a slot cover except when said plug body is in said second position.

2. A method for rekeying a lock cylinder, comprising the activities of:

inserting a key into a plug assembly disposed in a cylinder body, said cylinder body having a longitudinal axis and defining a longitudinally spaced, radially-aligned first plurality of pin chambers, each of said first plurality of pin chambers adapted to house a first pin, said cylinder body further defining a longitudinally extending slot therethrough, said plug assembly disposed in said cylinder body, said plug assembly comprising a plug body defining a clip-receiving slot, and a second plurality of pin chambers, each of said second plurality of pin chambers adapted to house a second pin;

rotating said plug assembly with said cylinder body from a first position to a second position, said first position aligning said second plurality of pin chambers with said first plurality of pin chambers, said second position aligning said second plurality of pin chambers with said slot, and removing said second plurality of pins from said second plurality of pin cambers when said plug body is in said second position, wherein said activity of removing said second plurality of pins is performed without removing a plug clip adapted to prevent longitudinal separation of said plug assembly from said cylinder body.

* * * * *